US008283538B2

(12) United States Patent
Rieger

(10) Patent No.: US 8,283,538 B2
(45) Date of Patent: Oct. 9, 2012

(54) STRING OF A MUSICAL INSTRUMENT

(75) Inventor: Bernhard Rieger, Vienna (AT)

(73) Assignee: Thomastik-Infeld Gesellschaft m.b.H., Vienna (AT)

( * ) Notice: Subject to any disclaimer, the term of this patent is extended or adjusted under 35 U.S.C. 154(b) by 158 days.

(21) Appl. No.: 12/679,775

(22) PCT Filed: Sep. 25, 2007

(86) PCT No.: PCT/AT2007/000450

§ 371 (c)(1),
(2), (4) Date: Jun. 28, 2010

(87) PCT Pub. No.: WO2009/039538

PCT Pub. Date: Apr. 2, 2009

(65) Prior Publication Data

US 2010/0294109 A1 Nov. 25, 2010

(51) Int. Cl.
*G10D 3/00* (2006.01)

(52) U.S. Cl. ..... 84/297 S

(58) Field of Classification Search ..... 84/297 S, 84/297 R; 264/473

See application file for complete search history.

(56) References Cited

U.S. PATENT DOCUMENTS

| | | | | |
|---|---|---|---|---|
| 4,120,146 | A | 10/1978 | Robin | |
| 5,601,762 | A * | 2/1997 | Ferrari et al. | 264/473 |
| 6,709,347 | B1 * | 3/2004 | Ono et al. | 473/319 |
| 2006/1254405 | | 11/2006 | Bergman | |
| 2010/0071529 | A1 * | 3/2010 | Infeld | 84/297 S |

FOREIGN PATENT DOCUMENTS

| | | |
|---|---|---|
| DE | 27 04 836 | 8/1978 |
| EP | 0 593 762 | 4/1994 |
| EP | 0 611 110 | 8/1994 |
| GB | 897 155 | 5/1962 |
| JP | 03205070 | 9/1991 |
| JP | 07150434 | 6/1995 |

* cited by examiner

*Primary Examiner* — Kimberly Lockett
(74) *Attorney, Agent, or Firm* — Henry M. Feiereisen, LLC

(57) ABSTRACT

In the case of a string of a musical instrument (1) with at least one composite core (2), wherein the at least one composite core (2) comprises a first core element (3) and a second core element (4), to achieve high volumes with little expenditure of force to excite the string as well as a rapid and precise response to quick changes of excitation, in particular quick bow changes, to achieve a natural sound and to extend a musician's artistic range, it is proposed that the first core element (3) and the second core element (4) comprise at least one organic material, and that the first core element (3) and the second core element (4) are joined at least in certain regions by means of a first polymer element (11) lying therebetween.

31 Claims, 3 Drawing Sheets

STRING OF A MUSICAL INSTRUMENT

CROSS-REFERENCES TO RELATED APPLICATIONS

This application is the U.S. National Stage of International Application No. PCT/AT2007/000450, filed Sep. 25, 2007, which designated the United States and has been published as International Publication No. WO 2009/039538.

BACKGROUND OF THE INVENTION.

The invention relates to a string of a musical instrument, comprising at least one composite core, with the at least one composite core comprising a first core element and a second core element, with the Strings are known with a core of fine steel wires, carbon and/or silicon carbide fibers, with the wires of the core being embedded in an elastomer or a ductile metal.

The disadvantageous aspect in such strings is that they can be excited only by applying a high speed of the bow and high pressure of the bow and are only suitable within limits for making music in a dynamic manner and/or with a differentiated timbre. Such strings come with the further disadvantage that they respond badly to a change of bow, so that these strings are perceived by musicians as slow and decelerating, and it is only possible within limits to intonate or play quick passages or perform a change of bow with such strings in a clean way.

Strings of musical instruments are further known in which the core comprises a number of separate core elements, e.g. in the form of fine steel wires, which form the core of the string in a substantially parallel arrangement.

In addition to the disadvantages as already explained above, such strings come with the further disadvantage that they have a sound that is perceived to be harsh and distorted with a large number of inharmonic components.

SUMMARY OF THE INVENTION

It is therefore the object of the invention to provide a string for musical instruments of the kind mentioned with which the mentioned disadvantages can be avoided and with which high volumes can be achieved at low speed of the bow for excitation, requiring a low minimum pressure of the bow for controlling the string, which responds rapidly and precisely to quick changes in excitation, especially rapid changes of the bow, offers a natural sound rich in timbre, and which expands the possibilities of artistic expression, by making it possible to play in a dynamically differentiated manner in respect of timbre.

This is achieved in accordance with the invention in such a way that the first core element and the second core element comprise at least one organic material, and the first core element and the second core element are joined at least in certain regions by means of a first polymer element which is disposed between the same and/or envelopes the same.

A string is thus created with which a high volume can be achieved in a simple way at low bow speed for the excitation, which requires a low minimal bow pressure for controlling the string, and which responds rapidly and precisely to changes in excitation, especially rapid bow changes, which offers a natural sound which extends the musician's possibilities for artistic expression and which allows dynamic play which is differentiated in timbre.

A string in accordance with the invention can be dampened in a predeterminable purposeful manner by choosing the first polymer element and/or the organic material of the at least one first and second core element. Disturbing vibrations of the string, especially torsional, longitudinal and/or bending vibrations, can be dampened in a purposeful manner, through which sound of the string will become more harmonic. It is thus also possible to emphasize individual frequency ranges in a purposeful manner. A string in accordance with the invention is also able to better follow a bow change than a string with a core made of steel, carbon and/or silicon carbide because a string in accordance with the invention can be dampened in a purposeful way, and thus has a lower tendency of maintaining its momentary state of movement. Less energy needs to be transmitted to the string by the bow in order to bring the string to another vibratory state than in the case of a string without the polymer element or with a steel core which has a lower inner damping. As a result, a musician playing on an instrument with the strings in accordance with the invention can intone and play rapid passages or bow changes better in tune, thus expanding the musician's possibilities for artistic expression. A string in accordance with the invention can also be excited in a simple way and, at the same bow speed, has a larger deflection than a string made with a core of steel, carbon and silicon carbide, because the core elements made of organic material have a larger extension under the same load and at the same bow speed. As a result, a larger volume can be achieved more easily when playing a string in accordance with the invention on a musical instrument. The deflection of the string and thus the volume can thus also be controlled more easily by the musician, thus also increasing the musician's possibilities for artistic expression with a string in accordance with the invention. Such a string can further be controlled with a low bow pressure.

Strings in accordance with the invention have a far more harmonious vibration behavior than strings made of a core of steel, carbon and silicon carbide. That is why the harmonics of a vibrating string in accordance with the invention corresponds better to the even harmonics of an ideal vibrating string. In the case of strings in accordance with the invention, the influence of bending stiffness is lower in the case of strings or their cores tensioned to a lower extent than in the case of strings made of steel, carbon or silicon carbide, which is why they have lower inharmonicities.

In the case of known strings with a core made of a plurality of core elements which are not connected by a polymer element, the individual core elements will rub against one another during a vibration of the string. As a result of the adhering and sliding phases which occur during friction, core elements which adhere to one another but are movable will adhere to one another up to a certain load, especially thrust, in order to detach suddenly and erratically, through which the harmonics of such strings no longer correspond to the ideal even harmonics. As a result of the coupling or connection of the strings in accordance with the invention through the at least one first polymer element, the damping of the string rather resembles the ideal viscous damping which is directly proportional to the speed. Strings in accordance with the invention therefore have a natural, harmonic and richly colored sound.

It can be provided in a further development of the invention that at least one third core element is provided which comprises at least one organic material. This offers further possibilities of improving the damping and the deflection properties of a string.

In this connection it can be provided in a further development of the invention that the composite core is arranged as a cable and the core elements are twisted together and/or interwoven. This leads to an especially durable and flexible composite core.

It can be provided according to a further embodiment of the invention that the composite core is wrapped around with at least one winding element, especially a flat strip and/or one that is round at least in sections, comprising metal, plastic and/or silk. Strings for low basic tones can thus also be created because additional mass can be applied by the winding element without changing the tension of the string. The basic pitch of a string will thus become lower.

It can be provided according to yet another embodiment of the invention that the composite core is wrapped around by a second polymer element which especially adheres to the same. The damping of the string can thus be increased even further. Further mass can thus be applied to the string and thus the tone of the string can be changed without any change to the tension of the string. The composite core can thus also be protected from damage.

One variant of the invention can be that the composite core and/or at least one of the core elements comprises at least one metal coating. Further mass can thus be applied to the string and thus the tone of the string can be changed without any change to the tension of the string. The composite core can thus also be protected from damage. As a result, a surface can be applied to the composite core which advantageously supports the absorption of rosin, thus improving the excitation of the string by sweeping with a bow.

It can be provided in a further embodiment of the invention that at least one core element is arranged as a polymer fiber, especially comprising polyamides, aramid fibers, PEK, PEEK, PBT, polyester, polyethylene, PET, PEET, PES, PE, PP, POM, PTFE, PVDF, PVDC and/or PVC. This allows for an especially advantageous arrangement of a string.

It can be provided in a further development of the invention that the cross section of at least one core element is arranged to be round, the segment of a circle, a polygon, approximately triangular, hexagonal, and/or trapezoid. The strings can thus better be adjusted to the different frequency ranges of different requirements such as a string for the high or bass range.

Another possible embodiment could also be that the composite core comprises at least one inner core element and at least three outer core elements. A symmetric composite core can thus be created which has especially harmonic vibratory properties.

According to a further embodiment of the invention it can be provided that the at least one inner core element and/or at least one of the at least three outer core elements are arranged as a composite core. Thick strings which are used in the bass range for example can thus be arranged in a flexible manner in order to be adjusted to the different requirements by the musicians.

In this connection it can be provided in a further development of the invention that the inner core element comprises a third polymer element, and at least one of the at least three outer core elements comprises a fourth polymer element. This allows for further flexible arrangements of a string in accordance with the invention which have especially good vibration properties.

It can be provided in a further development of the invention that a fifth polymer element is arranged at least in sections in at least one region between an inner core element and an outer core element and/or between two outer core elements. This allows for further flexible arrangements of a string in accordance with the invention which have especially good vibration properties.

It can be provided according to a further embodiment of the invention that the first, second, third, fourth and/or fifth polymer element is a visco-elastic and/or rubber-elastic polymer element. An especially advantageous damping of the string can be achieved by a visco-elastic and/or rubber-elastic polymer element. Individual frequency ranges of the vibrating string can be dampened by a suitable choice of a visco-elastic and/or rubber-elastic polymer element and other frequency ranges can be amplified, through which sound character of the string can be influenced.

One variant of the invention can be that the first, second, third, fourth and/or fifth polymer element is a visco-elastic polymer fluid and/or an elastomer. An especially efficient damping of the string can thus be realized, with the visco-elastic polymer fluid adhering very well to the core elements and providing the string with an especially high amount of mobility, and an elastomer offering a high amount of inner cohesion and exerting an additional restoring force on the string.

It can be provided in a further embodiment of the invention that the first, second, third, fourth and/or fifth polymer element has a non-linear elastic behavior. It can thus be achieved that individual movement phases of the string are dampened in another way, especially more strongly or weaker, than other movement phases. As a result, individual vibration modes such as torsional vibrations can be dampened more strongly than other vibration modes such as transverse vibrations.

It can be provided according to a further arrangement of the invention that the first, second, third, fourth and/or fifth polymer element has a modulus of elasticity of less than 10000 $N/mm^2$, preferably less than 1000 $N/mm^2$, especially less than 100 $N/mm^2$. It can thus be achieved that the polymer element does not bear any string tension and that therefore the entire load of the tensioned string is borne by the core elements. The string thus offers better vibration properties because the core elements are loaded more strongly and the bending stiffness of the core elements is lower than in the less loaded state, through which the string is capable of forming a larger number of harmonics in a harmonically pure manner.

According to a further embodiment of the invention it can be provided that the ultimate elongation of the first, second, third, fourth and/or fifth polymer element is larger than the ultimate elongation of one of the core elements, especially that the first, second, third, fourth and/or fifth polymer element has an ultimate elongation of at least 2%, especially at least 5%, of its original length. Since the at least one polymer element has a higher ultimate elongation than the core elements, it can be ensured that in the case of intact core elements no tearing of one of the polymer elements will occur, which would thus lead to a reduction in the sound quality of the string.

According to yet another embodiment of the invention it can be provided that the first, second, third, fourth and/or fifth polymer element adheres at least in sections to one of the core elements. An especially good and even damping of the core elements can thus be achieved.

One variant of the invention can be that the first, second, third, fourth and/or fifth polymer element comprises at least one metal, especially a metal with a density of more than 10000 $kg/m^3$, preferably comprising tungsten, lead, gold, rhenium, osmium, iridium and/or platinum, especially a metal powder. A mass coating can also be applied to the string together with the at least one polymer element. The diameter of a string can thus be kept very small, thus reducing the occurrence of torsional vibrations by the bow.

It can be provided in a further embodiment of the invention that the first, second, third, fourth and/or fifth polymer element comprises natural resin, synthetic resin, PU, PET, PEET, silicone, PTFE, bitumen and/or asphalt. Numerous advantageous further developments of a string in accordance with the invention can be formed.

It can be provided in a further development of the invention that when the string is tensioned the first, second, third, fourth and/or fifth polymer element is free of tension, preferably to a substantial extent. It can thus be achieved that the polymer element increases the inner damping of the string without absorbing any relevant forces itself. It can thus be achieved that the core elements are loaded more strongly and are therefore operated close to their yield point, which is therefore in a range in which the bending stiffness of the core elements is especially low and the string is therefore capable of forming an especially distinct "Helmholtz corner" during the bowing or plucking of the string, which is thus decisive for the harmonics content and thus the timbre. Strings can thus be formed which have a very colorful sound, but which still have high inner damping which is important for a controlled bowing process and a rapid change of the bow.

BRIEF DESCRIPTION OF THE DRAWING.

The invention is now described in closer detail by reference to the enclosed drawings in which especially preferred embodiments are shown by way of example, wherein.

Figure 1:
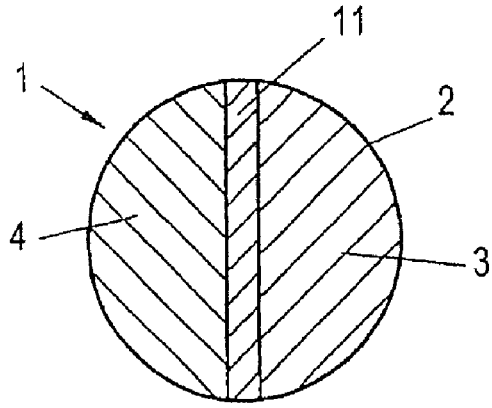
FIG. 1 shows the cross section of a first embodiment of a string in accordance with the invention.

DETAILED DESCRIPTION OF PREFERRED EMBODIMENTS.

FIGS. 1 to 9 show different embodiments of strings 1 with at least one composite core 2, with the at least one composite core 2 comprising a first core element 3 and a second core element 4, with the first core element 3 and the second core element 4 comprising at least one organic material, and the first core element 3 and the second core element 4 being joined at least in sections by means of an interposed first polymer element 11 and/or one which wraps around the same.

A string 1 is thus created with which high volumes can be achieved in a simple way at low speed of the bow for the excitation, which requires a minimum bow pressure for controlling the string 1 and which responds rapidly and precisely to a quick change of excitation, especially quick change of bow, which has a natural sound, which expands the possibilities of artistic expression, and which enables playing in a dynamically differentiated manner in respect of timbre.

A string 1 is thus formed which can be dampened in a purposeful manner. Disturbing vibrations of the string 1, especially torsional, longitudinal and/or bending vibrations, can thus be dampened in a purposeful manner, through which sound of the string 1 will become more harmonic. It is thus also possible to emphasize the vibration frequency of string 1 in a purposeful manner, thus changing its timbre in that core elements 3, 4 and first polymer element 11 are chosen in such a way that they lead to overemphasizing of the vibration amplitude in specific predeterminable frequency ranges of the sound spectrum of the vibrating string 1. This can be achieved in such a way for example that the core elements 3, 4 and the first polymer element 11 are chosen in such a way that the composite core has a resonance frequency at a predeterminable frequency of a harmonic, through which said harmonic is excited more strongly at a respectively excited basic tone and influences the timbre of the string 1. A string 1 in accordance with the invention is also able to better follow a bow change than a string with a core made of steel, carbon and/or silicon carbide because a string 1 in accordance with the invention can be dampened in a purposeful way, and thus has a lower tendency of maintaining its momentary state of movement. Less energy needs to be transmitted to the string 1 by the bow in order to bring the string 1 to another vibratory state than in the case of a string without the polymer element or with a steel core which has a lower inner damping. As a result, a musician playing on an instrument with the strings 1 in accordance with the invention can intone and play rapid passages or bow changes better in tune, thus expanding the musician's possibilities for artistic expression. A string 1 in accordance with the invention can also be excited in a simple way and, at the same bow speed, has a larger deflection than a string made with a core of steel, carbon and silicon carbide, because the core elements 3, 4 made of organic material have a larger extension under the same load and at the same bow speed. As a result, a larger volume can be achieved more easily when playing a string 1 in accordance with the invention on a musical instrument. The deflection of the string 1 and thus the volume can thus also be controlled more easily by the musician, thus also increasing the musician's possibilities for artistic expression with a string 1 in accordance with the invention. Such a string 1 can further be controlled with a low bow pressure, thus reducing the likelihood of the so-called "wolf tones".

Strings 1 in accordance with the invention have a far more harmonious vibration behavior than strings made of a core of steel, carbon and silicon carbide. That is why the harmonics of a vibrating string 1 in accordance with the invention correspond better to the even harmonics of an ideal vibrating string 1. In the case of strings 1 in accordance with the invention, the influence of bending stiffness is lower in the case of strings 1 or their cores tensioned to a lower extent than in the case of strings made of steel, carbon or silicon carbide, which is why they have lower inharmonicities.

In the case of known strings with a core made of a plurality of core elements which are not connected by a polymer element, the individual core elements will rub against one another during a vibration of the string. As a result of the adhering and sliding phases which occur during friction, core elements which adhere to one another but are movable will adhere to one another up to a certain load, especially thrust, in order to detach suddenly and erratically, through which the harmonics of such strings no longer correspond to the ideal even harmonics. As a result of the coupling or connection of the core elements 3, 4 in strings 1 in accordance with the invention through the at least one first polymer element 11, the damping of the string 1 rather resembles the ideal viscous damping which is directly proportional to the speed. Strings 1 in accordance with the invention therefore have a natural, harmonic and richly colored sound.

A preferred field of use for such musical strings 1 is the instruments of the family of violins such as the violin, viola, cello and bass and contrabass. The use is especially preferred in string instruments, in which the string 1 is excited by bowing. Such strings 1 in accordance with the invention can principally be provided for all stringed and plucked instruments such as cembalos, harps, banjos, sitars, dulcimers, zithers, lutes, oods, p'i-p'as, gekkins, balalaikas, vinas, tampuras, kotos, sohs, guitars, mandolins, etc.

Strings 1 in accordance with the invention comprise at least one composite core 2 which comprises at least one first and one second core element 3, 4. Especially preferable embodiments of strings 1 in accordance with the invention comprise at least three core elements 3, 4, 5. Especially preferred embodiments of strings 1 in accordance with the invention comprise a predeterminable number of core elements 3, 4, 5. Seven core elements 3, 4, 5 can especially be provided for example.

The core elements 3, 4, 5 comprise at least one organic material and/or are formed from an organic material. The organic material may concern any kind of organic material, e.g. any kind of organic plastic such as polymer fibers, especially comprising polyamides, aramid fibers, PEK, PEEK, PBT, polyester, polyethylene, PET, PEET, PES, PE, PP, POM, PTFE, PVDF, PVDC and/or PVC, any kind of fiber of plant and/or animal origin such as silk and/or gut. Core elements 3, 4, 5 are especially preferred which comprise organic plastic and/or gut, especially sheep gut.

The first core element 3 and the second core element 4 of an especially simple first preferred embodiment according to FIG. 1 are connected at least in sections by means of an interposed first polymer element 11, with the polymer element 11 comprising any kind of polymer. The polymer preferably concerns any kind of substance which is made up of a plurality of molecules in which a kind or several kinds of atoms or atom groupings (so-called constitutive units, basic components or repeating units) are arrayed together repeatedly.

Core elements 3, 4, 5 in accordance with the invention can have a predeterminable shape and a predeterminable cross section. It can especially be provided that the cross section of at least one of the core elements 3, 4, 5 is arranged to be round, the segment of a circle, a polygon, approximately triangular, hexagonal, and/or trapezoid.

In a first preferred embodiment of a string 1 in accordance with FIG. 1, a first core element 3 and a second core element 4 are provided which comprise the same, substantially semicircular, cross sections, with the two core elements 3, 4 being connected by a first polymer element 11.

Figure 2:
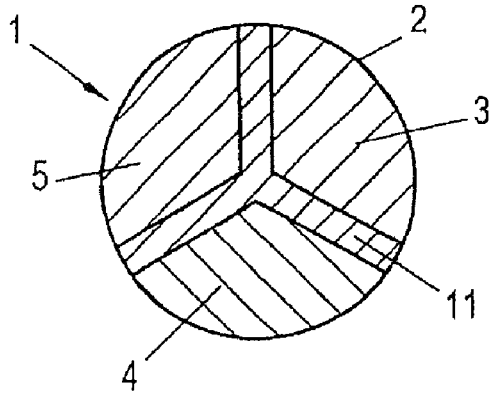
FIG. 2 shows the cross section of a second embodiment of a string in accordance with the invention.

In a second preferred embodiment according to FIG. 2, a third winding element 5 is further provided, with the first, second and third winding element 3, 4, 5 having the same cross section in the form of a segment of a circle in the second preferred embodiment.

In accordance with the invention, any predeterminable number of core elements 3, 4, 5 can be provided. It can also be provided that core elements 3, 4, 5 which differ in their shape and material are joined into a composite core 2.

It can be provided that one identical first polymer element 11 each is arranged in the regions between the three core elements 3, 4, 5. It is also possible to provide different polymer elements 11 between the different core elements 3, 4, 5.

Figure 3:
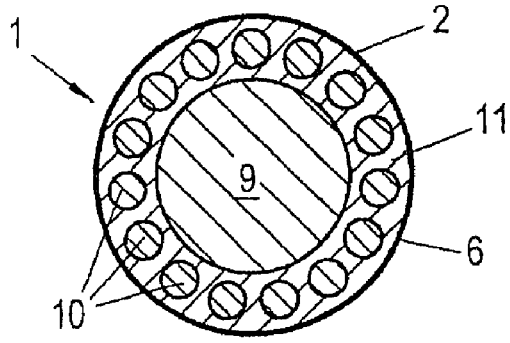
FIG. 3 shows the cross section of a third embodiment of a string in accordance with the invention.

In a third preferred embodiment of a string 1 in accordance with the invention according to FIG. 3, a plurality of outer core elements 10, especially at least three thereof, are arranged about an inner core element 9. The outer core elements 10 and the inner core element 9 can be arranged to be identical. It can be provided as in the third preferred embodiment according to FIG. 3 that the inner core element 9 has another cross section, especially a larger one, than the outer core elements 10.

It can be provided that a string 1 in accordance with the invention merely comprises the core elements 3, 4, 5, 9, 10 and the first polymer element 11, and no further elements such as coatings and/or windings. It can also be provided, as in the third preferred embodiment according to FIG. 3, that the composite core 2 and/or at least one of the core elements 3, 4, 5, 9, 10 comprises at least one metal coating 6, through which a surface can be applied to the composite core 2 which advantageously supports the absorption of rosin, thus improving the excitation of the string by sweeping with a bow. It is also possible to provide several metal coatings 6 above one another, especially two and/or three metal coatings 6. Any metal can be provided for the metal coating 6, especially a metal chosen from the group of tin, gold, aluminum, aluminum alloy, titanium, titanium alloy, molybdenum, molybdenum alloy, tungsten, tungsten alloy, palladium, palladium alloy, rhodium, rhodium alloy. A metal coating 6 can be provided in any string 1 in accordance with the invention. In particular, such a metal coating 6 can be provided in any of the preferred embodiments. The third preferred embodiment of a string 1 can also be provided without any metal coating 6.

Figure 4:
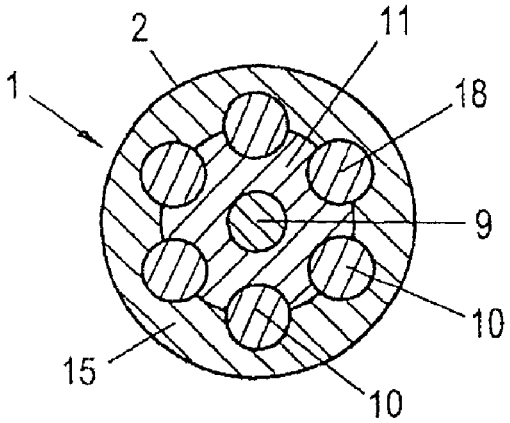
FIG. 4 shows the cross section of a fourth embodiment of a string in accordance with the invention.

It is provided in accordance with the invention that the at least two core elements 3, 4 are joined at least in sections by means of an interposed first polymer element 11. It can also be provided that a fifth polymer element 15 is arranged at least in sections in at least one region between an inner core element 9 and an outer core element 10 and/or between two outer core elements 10. FIG. 4 shows a fourth preferred embodiment of a string 1 in accordance with the invention with an inner core element 9 and six outer core elements 10, with a first polymer element 11 being arranged between the inner core element 9 and the outer core elements 10, and a fifth polymer element 15 on top of or between the outer core elements 10, with the outside surface of the string 1 being formed by the fifth polymer element 15 in the fifth preferred embodiment.

Figure 5:
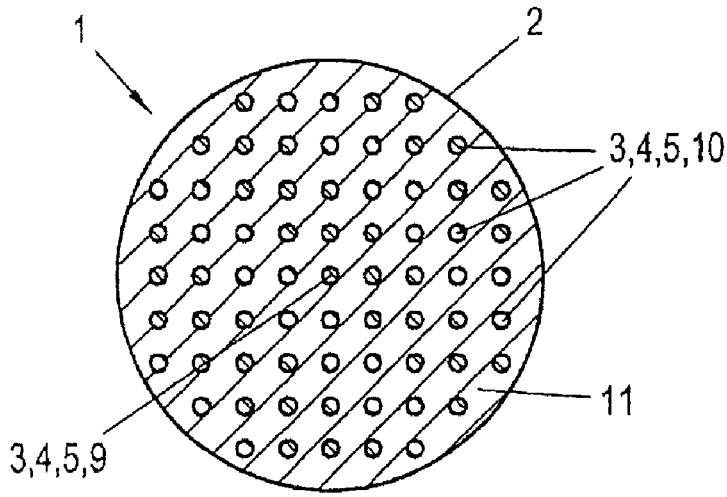
FIG. 5 shows the cross section of a fifth embodiment of a string in accordance with the invention.
Figure 6:
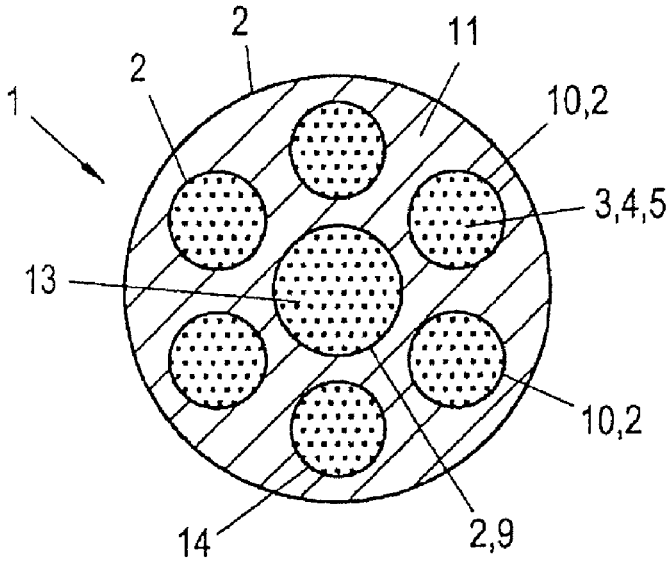
FIG. 6 shows the cross section of a sixth embodiment of a string in accordance with the invention.

In a fifth preferred embodiment of a string 1 in accordance with the invention as shown in FIG. 5, a predeterminable number of core elements 3, 4, 5, 9, 10 are arranged. They can be arranged substantially parallel in the string 1, but also arranged in the form of a cable, as is provided in the description of the eighth preferred embodiment of a string 1 in accordance with the invention according to FIGS. 8 and 9.

In accordance with the invention, each core element 3, 4, 5, 9, 10 can be provided to comprise an organic material. As is shown in an especially preferred sixth embodiment of a string according to FIG. 6, it can be provided in an especially preferred manner with an inner core element 9 and six outer core elements 10 and the at least one inner core element 9 and/or at least one of the at least three outer core elements 10 is arranged as a composite core 2, through which especially thick strings 1 can be arranged in a flexible way, as are used in the bass range, in order to be adaptable to different requirements by the musicians. In the embodiment of the inner and/or outer core elements 3, 4, 5, 9, 10 as a composite core 2 it can be provided that the inner core element 9 comprises a third polymer element 13 and at least one of the at least three outer core elements 10 comprises a fourth polymer element 14. It can therefore be provided that the third polymer element 13 which is arranged in the inner core element 9 is another polymer element 13 than the fourth polymer element 14 which is arranged in one of the outer core elements 10 and which can differ on its part from the first polymer 11 which holds together the inner core element 9 and the outer core elements 10.

Figure 7:
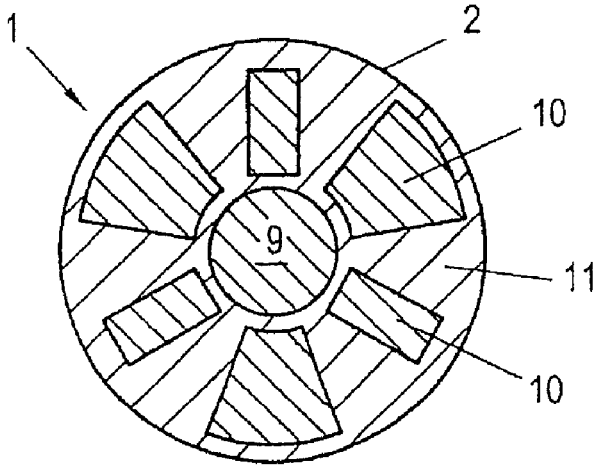
FIG. 7 shows the cross section of a seventh embodiment of a string in accordance with the invention.

As already explained, the at least two core elements 3, 4, 5, 9, 10 of a string 1 in accordance with the invention can have any predeterminable cross section. FIG. 7 shows an embodiment with an inner core element 9 which has a substantially round cross section and which is surrounded by six outer core elements 10 which have different cross sections. Three of the outer core elements 10 have a substantially rectangular cross section, whereas the other three outer core elements 10 have the cross sections of cylinder segments, with the outer core elements 10 of different cross sections being arranged in an alternating fashion.

As already explained, it can be provided that a string 1 in accordance with the invention comprises merely the core elements 3, 4, 5, 9, 10 and the first polymer element 10, but no further elements such as coatings and/or windings. It can preferably be provided that the composite core 2 is wrapped around with at least one winding element 7, especially a flat strip 8 and/or one that is round in sections, through which strings 1 can be created for low basic tones because additionally mass can be provided by the winding element 7 without changing the tension of the string or the pitch level. The at least one winding element 7 is wound in a preferably helical way about the composite core 2. The composite core 2 can thus be protected from damage. A winding element 7 for a string 1 in accordance with the invention can especially comprise any kind of metal, plastic and/or silk. Preferably, metals such as aluminum, copper, silver and tungsten are provided. Several layers of different windings elements 7 can especially also be provided. It can also be provided that a winding element 7 comprises at least one composite core 2 according to the present invention.

It can also be provided to arrange a metal coating 6 and at least one winding element 7 on the composite core 2.

Figure 9:
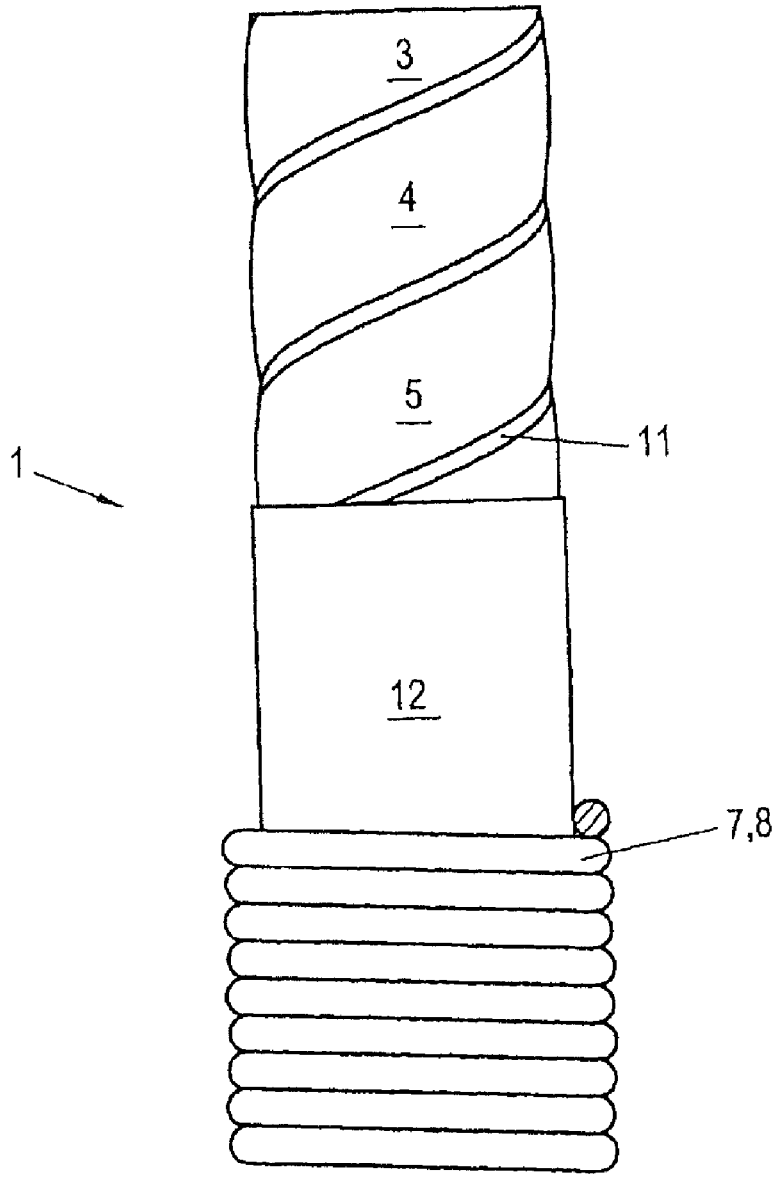
FIG. 9 shows the embodiment of a string in accordance with the invention in accordance with FIG. 8 in an elevated view.
Figure 8:
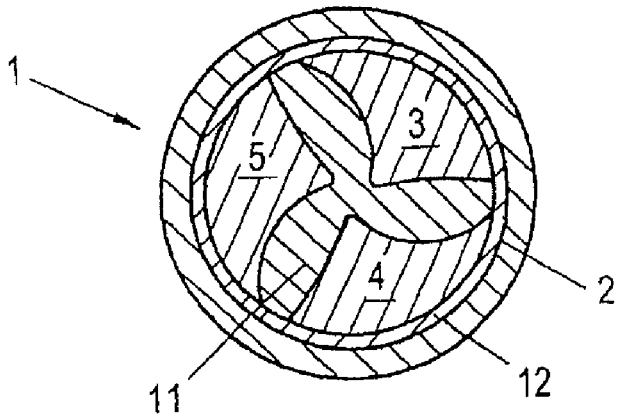
FIG. 8 shows the cross section of an eighth embodiment of a string in accordance with the invention.

The eighth preferred embodiment of a string in accordance with the invention according to FIGS. 8 and 9 comprises a composite core 2 comprising three similar core elements 3, 4, 5 of a non-symmetrical cross section, with the composite core 2 being wrapped around with a winding element 7 arranged as a strip 8 with a round cross section, as shown especially in FIG. 9. The composite core 2 is further wrapped around with a second polymer element 12 which adheres to the same in the preferred embodiment. Damping of the string 1 can be increased even further by the second polymer element 12. A further mass can thus be applied to the string 1 and the pitch of the string 1 can thus be changed without any changes being made to the tension of the string. The composite core 2 can thus be protected from damage, especially from damage during further production such as during the application of a winding element 7 or when the second polymer element 12 forms the outermost surface of the string 1.

As is shown in FIG. 9, the composite core 2 is arranged as a cable in the preferred eighth embodiment, with the core elements 3, 4, 5 being twisted together. It can be provided that the composite core 2 is arranged as a cable in each embodiment of a string 1 in accordance with the invention, especially in the above described especially preferred embodiments. It can also be provided that the core elements 3, 4, 5, 9, 10 are interwoven. Mixed forms between twisted and interwoven can also be provided. An especially flexible and durable string 1 can be created by arranging the composite core 2 as a cable core.

As already explained, the polymer element 11, 12, 13, 14, 15 can concern any kind of polymer.

It can be provided according to the invention that the first, second, third, fourth and/or fifth polymer element 11, 12, 13, 14, 15 is formed by another polymer each. It can also be provided that at least two of the polymer elements 11, 12, 13, 14, 15 are formed by identical polymers. It can further be provided that all the polymer elements 11, 12, 13, 14, 15 of a string are formed by a polymer, thus enabling an especially simple and cost-effective production of a string 1 in accordance with the invention.

It is preferably provided that the first, second, third, fourth and/or fifth polymer element 11, 12, 13, 14, 15 comprises natural resin, synthetic resin, PU, PET, PEET, silicone, PTFE, bitumen and/or asphalt.

Strings 1 are deflected from an idle position for generating sounds, with the string 1 expanding. Core elements 3, 4, 5, 9, 10 which are arranged to rest on one another in the strings 1 are co-expanded in this deflection. In the case of strings which do not comprise a polymer element which adheres to the individual core elements and connects the same, these core elements rub against one another. As a result of the static friction, the core elements adhere on one another up to a certain shear load of the core elements until the force is large enough to overcome static friction and the core elements are torn away from one another. This leads to a sudden movement of the core elements towards one another. This sudden movement and acceleration of the core elements leads to vibrations, especially longitudinal vibrations, in the known string which are superimposed over the intended transverse vibration of the string. In the case of instruments of the family of violins, these longitudinal vibrations are transported via the bridge to the cover and emitted from there, with these longitudinal vibrations not being in any harmonic connection with the fundamental frequency of the string 1, leading to a turbulent rough metallic sound.

This static/sliding friction can be prevented by the at least one first polymer element 11 which is arranged between the first and the second core element 3, 4. It is therefore preferably provided that the first, second, third, fourth and/or fifth polymer element 11, 12, 13, 14, 15 is a visco-elastic and/or rubber-elastic polymer element 11, 12, 13, 14, 15 which adheres especially at least in sections on one of the core elements 3, 4, 5, 9, 10. It can be achieved by the adherence to the core elements 3, 4, 5, 9, 10 that the core elements 3, 4, 5, 9, 10 form a composite core 2 in the manner of a composite material. Static/sliding friction between the individual core elements 3, 4, 5, 9, 10 can be prevented, and a viscous, and therefore speed-proportional, damping prevails.

A visco-elastic polymer element 11, 12, 13, 14, 15 can be understood to be any polymer which has visco-elastic properties, which therefore both flows as well as deforms elastically under the action of a force, with the ratio of viscous to elastic deformation share being dependent on time. During relaxation, the visco-elastic polymer deforms back by the elastic share, whereas a certain amount of deformation remains even in the relaxed state. The visco-elastic polymer element 11, 12, 13, 14, 15 can have a non-linear elastic behavior. Any visco-elastic polymer element 11, 12, 13, 14, 15 can be provided, especially polyamide, polyethylene and/or polypropylene. In an especially preferable way, a visco-elastic polymer fluid can be provided such as resins like epoxy resin, phenol resin and/or polyester resin.

A rubber-elastic polymer element 11, 12, 13, 14, 15 can be understood to be any polymer which substantially has the generally known behavior of rubber, latex, expanded rubber or silicone elastomer and the like, and therefore has a low modulus of elasticity, high ultimate elongation and non-linear elastic behavior which is in contrast to the behavior of so-called hard, brittle and stiff polymers such as ABS, cellulose plastics or polystyrene. Rubber-elastic polymers in the preferred sense of the invention are useful only within limits for cutting machining methods such as drilling, filing and/or turning. Any rubber-elastic polymer element 11, 12, 13, 14, 15 can be provided, especially any elastomer, preferably latex, caoutchouc and synthetic rubber (buna).

It can therefore be provided in an especially preferred way that the first, second, third, fourth and/or fifth polymer element 11, 12, 13, 14, 15 has a modulus of elasticity of less than 10000 N/mm$^2$, preferably less than 1000 N/mm$^2$, especially less than 100N/mm$^2$, with the modulus of elasticity in a polymer element 11, 12, 13, 14, 15 with a non-linear elastic behavior being determinable from a mean value from the elastic energy, e.g. as a mean value of the surface area under the curve in a stress-strain diagram. The modulus of elasticity can be determined as an ascending gradient of a straight line whose surface area over the expansion, i.e. its integral over the expansion, can be determined in a predeterminable expansion area, corresponding to the surface area beneath the curve in a stress-strain diagram of the non-linear elastic polymer element 11, 12, 13, 14, 15.

It can be provided especially in the case of polymers with rubber-elastic behavior, especially in the case of elastomers, that the ultimate elongation of the first, second, third, fourth and/or fifth polymer element 11, 12, 13, 14, 15 is larger than the ultimate elongation of one of the core elements 3, 4, 5, 9, 10, especially that the first, second, third, fourth and/or fifth polymer element 11, 12, 13, 14, 15 has an ultimate elongation of at least 2%, especially at least 5%, preferably 10%, of its original length.

The frequency of the first harmonic of a string 1 depends on its length, its mass coating and the force with which the same is tensioned. In the case of a given length, and force, which is generally designated as the pitch level, it is obtained that a higher mass coating is required for a lower frequency of the first harmonic, as is applied for example by at least one winding of the string 1 with a metal strip 8 on the string 1. In the case of an especially preferred embodiment of a string 1 in accordance with the invention, it can be provided that the first, second, third, fourth and/or fifth polymer element 11, 12, 13, 14, 15 comprises at least one metal, especially a metal with a density of more than 10000 kg/m$^3$, preferably comprising tungsten, lead, gold, rhenium, osmium, iridium and/or platinum, especially a metal powder. A mass coating can thus also be applied to the string 1 together with the at least one polymer element 11, 12, 13, 14, 15. The diameter of the string 1 can thus be kept low, as a result of which the generation of torsional vibrations by the bow can be prevented. By adding metal to at least one of the polymer elements 11, 12, 13, 14, 15, the density of the polymer element 11, 12, 13, 14, 15 can be increased and thus also the mass coating which is applied to the string 1 by the polymer element 11, 12, 13, 14, 15.

In accordance with the invention, further embodiments can have any combination of one or several features according to the claims. Embodiments can especially be provided which have merely a part of the described features, with any combination of features, especially such of different described embodiments, being provided.

The invention claimed is:

1. A string of a musical instrument, comprising:

at least one composite core having a first core element and a second core element, each of the first and second core elements including at least one organic material; and a first polymer element joining the first and second core elements at least in regions thereof, said first polymer element being disposed between the first and second core elements and/or enveloping the first and second core elements, wherein the first polymer element is substantially free of tension, when the string is tensioned at a predefined pitch level.

2. The string of claim 1, wherein the composite core has at least one third core element which comprises at least one organic material.

3. The string of claim 1, wherein the composite core is constructed in the form of a cable, with the core elements being twisted together and/or interwoven.

4. The string of claim 1, further comprising at least one winding element wrapped around the composite core and being made of at least one material selected from the group consisting of metal, plastic, and silk.

5. The string of claim 4, wherein the winding element is at least one member selected from the group consisting of a flat strip and a strip which is rounded at least in sections.

6. The string of claim 1, further comprising a second polymer element wrapped around the composite core.

7. The string of claim 6, wherein the second polymer element adheres to the composite core.

8. The string of claim 1, wherein the composite core and/or at least one of the core elements includes at least one metal coating.

9. The string of claim 1, wherein at least one of the core elements is a polymer fiber.

10. The string of claim 9, wherein the polymer fiber includes a composition selected from the group consisting of polyamides, aramid fibers, PEK, PEEK, PBT, polyester, polyethylene, PET, PEET, PES, PE, PP, POM, PTFE, PVDF, PVDC, and PVC.

11. The string of claim 1, wherein at least one of the core elements has a cross section selected from the group consisting of a round cross section, in the form of a segment of a circle, and a polygonal cross section.

12. The string of claim 1, wherein the first core element is at least one inner core element, and the second core element includes at least three outer core elements.

13. The string of claim 12, wherein the at least one inner core element and/or at least one of the at least three outer core elements are constructed as a composite core.

14. The string of claim 12, wherein the inner core element comprises a third polymer element, and at least one of the at least three outer core elements comprises a fourth polymer element.

15. The string of claim 14, further comprising a fifth polymer element arranged at least in sections in at least one region between the inner core element and one of the outer core elements and/or between two of the outer core elements.

16. The string of claim 15, wherein at least one of the first, second, third, fourth and fifth polymer elements is a visco-elastic and/or rubber-elastic polymer element.

17. The string of claim 15, wherein at least one of the first, second, third, fourth and fifth polymer elements is a visco-elastic polymer fluid and/or an elastomer.

18. The string of claim 15, wherein at least one of the first, second, third, fourth and fifth polymer elements has a non-linear elastic behavior.

19. The string of claim 15, wherein at least one of the first, second, third, fourth and fifth polymer elements has a modulus of elasticity of less than 10000 N/mm$^2$.

20. The string of claim 15, wherein at least one of the first, second, third, fourth and fifth polymer elements has a modulus of elasticity of less than 1000 N/mm$^2$.

21. The string of claim 15, wherein at least one of the first, second, third, fourth and fifth polymer elements has a modulus of elasticity of less than 100 N/mm$^2$.

22. The string of claim 15, wherein at least one of the first, second, third, fourth and fifth polymer elements has an ultimate elongation which is greater than an ultimate elongation of one of the core elements.

23. The string of claim 22, wherein the ultimate elongation of the at least one of first, second, third, fourth and fifth polymer elements is at least 2% of its original length.

24. The string of claim 22, wherein the ultimate elongation of the at least one of first, second, third, fourth and fifth polymer elements is at least 5% of its original length.

25. The string of claim 15, wherein at least one of the first, second, third, fourth and fifth polymer elements adheres at least in sections to one of the core elements.

26. The string of claim 15, wherein at least one of the first, second, third, fourth and fifth polymer elements comprises at least one metal selected from the group consisting of tungsten, lead, gold, rhenium, osmium, iridium, and platinum.

27. The string of claim 26, wherein the metal is a metal with a density of more than 10000 $kg/m^3$.

28. The string of claim 26, wherein the metal is a metal powder.

29. The string of claim 15, wherein at least one of the first, second, third, fourth and fifth polymer elements comprises a material selected from the group consisting of natural resin, synthetic resin, PU, PET, PEET, silicone, PTFE, bitumen, and asphalt.

30. The string of claim 15, wherein at least one of the first, second, third, fourth and fifth polymer elements is substantially free of tension, when the string is tensioned at a predeterminable pitch level.

31. The string of claim 11, wherein the polygonal cross section is in the form of a triangle, hexagon, or trapezoid.

* * * * *